US007814581B1

(12) United States Patent
Willner

(10) Patent No.: US 7,814,581 B1
(45) Date of Patent: Oct. 19, 2010

(54) DEVICE FOR A PERSON TO REDUCE STRAINING DURING EXPULSION OF FECAL MATTER INTO A TOILET

(76) Inventor: Jeffrey S. Willner, 3615 Oxford Ave., Apt. 6, Bronx, NY (US) 10463

( * ) Notice: Subject to any disclaimer, the term of this patent is extended or adjusted under 35 U.S.C. 154(b) by 0 days.

(21) Appl. No.: 12/386,084

(22) Filed: Apr. 14, 2009

(51) Int. Cl.
*E03D 11/00* (2006.01)

(52) U.S. Cl. ..... 4/254; 297/423.41; D6/349

(58) Field of Classification Search ..... 4/254; 297/423.41; D6/349, 352
See application file for complete search history.

(56) References Cited

U.S. PATENT DOCUMENTS 1,976,170 A * 10/1934 Hoover et al. ..... 297/423.41 X
2,256,994 A 9/1941 Warshaw
D139,504 S * 11/1944 Sadler ..... D6/349
D251,889 S * 5/1979 Henning et al. ..... D6/349
4,713,846 A * 12/1987 Hodroski, Jr. ..... 4/254
4,968,091 A * 11/1990 Mariol ..... 297/423.41 X
4,979,240 A * 12/1990 Welles ..... 4/254
5,553,334 A 9/1996 Hillman
5,809,583 A 9/1998 Pucciani
6,148,448 A 11/2000 Urso
6,256,800 B1 7/2001 Isbit
6,631,524 B1 10/2003 Dixon
6,681,410 B1 1/2004 Husain
2003/0019020 A1 1/2003 Reydel
2004/0177433 A1 9/2004 Reydel

* cited by examiner

*Primary Examiner*—Robert M Fetsuga
(74) *Attorney, Agent, or Firm*—Richard L. Miller

(57) ABSTRACT

A device for a person to reduce straining during expulsion of fecal matter into a toilet. The device comprises a block-shaped footrest placed on a floor in front of the toilet. The person sitting on the toilet will place both feet upon the block-shaped footrest to elevate his/her lower body into a quasi-squat position without any change to above-the-waste posture to reduce straining significantly.

5 Claims, 2 Drawing Sheets

DEVICE FOR A PERSON TO REDUCE STRAINING DURING EXPULSION OF FECAL MATTER INTO A TOILET

BACKGROUND OF THE INVENTION

1. Field of the Invention

The present invention relates to a toilet accessory, and more particularly, a device for a person to reduce straining during expulsion of fecal matter into a toilet.

2. Description of the Prior Art

Numerous innovations for constipation-relieving apparatuses have been provided in the prior art that will be described. Even though these innovations may be suitable for the specific individual purposes to which they address, however, they differ from the present invention.

A FIRST EXAMPLE, U.S. Pat. No. 2,256,994, Issued on Sep. 23, 1941, to Warshaw teaches a toilet seat of the character described comprising a horizontal body having an oval hole therethrough; a pivotally mounted contact member disposed on the seat, in the hole thereof to one side of the major access and near one end thereof to engage there occupant of the seat to one side of the anus thereof; and means for moving the contact member around its pivotal connection, the pivotal connection being spaced rearwardly of the anus of the occupant whereby upon movement of the contact member about the pivotal connection, upward and rearward pressure is exerted to straighten the ano-rectal canal of the seated occupant, the means for moving the contact member comprising a worm gear rotatably mounted on the seat, a gear in mesh with the worm gear, an operating shaft in connection with the worm gear extending to a point within reach of the seated occupant, a drum provided with a cam slot rigid with the gear, and a head on the contact member projecting into the slot whereby upon rotation of the gear and drum the contact member will be moved about the pivotal connection, the contact member having a resilient covering thereon thicker along the innermost edge thereof than throughout the remaining portion.

A SECOND EXAMPLE, U.S. Pat. No. 5,553,334, Issued on Sep. 10, 1996, to Hillman teaches a new and improved curved toilet bowl specifically adapted to protect a user's colon including a bowl having a first side, a second side, a forward portion, a rearward portion, and an oval upper opening having a forward extent and a rearward extent. The bowl further includes a lower base and a hollow interior. The oval upper opening slopes gradually upwardly from the rearward extent to forward extent. The upper opening also has a peripheral thickness which increases from the rearward extent to the forward extent. The forward extent of upper opening functions to support the knees and the underside of the upper legs of the user. The footrest has a top surface, an upwardly inclined forward portion, and a rearward portion. The rearward portion includes a recessed edge. The recessed edge is specifically adapted to be removably secured to the lower base of the bowl.

A THIRD EXAMPLE, U.S. Pat. No. 5,809,583, Issued on Sep. 22, 1998, to Pucciani teaches a toilet having a toilet bowl, a toilet seat as well as two footrest members located in a certain distance above the floor, but below the toilet seat. The elongate footrest area of the footrest members extend in an angle with the central longitudinal axis of the toilet bowl. The footrest areas of the footrest members are located essentially in front of the toilet bowl. Moreover, the toilet seat is inclined with reference to the upper horizontal opening of the toilet bowl such as to slope forwardly downwards. In such a toilet, the user is enabled to take a natural, squatting sitting posture in which the angle between the thighs and the torso is between 20 degrees. and 50 degrees. during defecation; thus, the pelvic musculature is fully relaxed.

A FOURTH EXAMPLE, U.S. Pat. No. 6,148,448, Issued on Nov. 21, 2000, to Urso teaches a portable squat support for supporting a user in an advantaged posture to facilitate defecation while on a toilet. Included is an elongate, cushioned, horizontal upper body support and upright members for supporting the body support in front of the toilet so that the user's forward leaning upper body is supported on the body support. A footrest is connected to the upright members and positioned below the body support for supporting the user's legs in an elevated bent position. A footrest height-adjusted for vertically adjusting the footrest is included. A height scale having graduated marks that represent heights of potential users is displayed on the squat support. The marks are arranged cooperatively with the height-adjuster for guiding a user to vertically adjust the footrest to a predetermined position that is particularly advantageous for the user according to the user's height. A device for adjusting the footrest at selective pitch angles is also provided. Among embodiments disclosed, are embodiments having respective drivers for raising and lowering the footrest with the user's legs supported on the footrest.

A FIFTH EXAMPLE, U.S. Pat. No. 6,256,800, Issued on Jul. 10, 2001, to Isbit teaches a toilet accessory with a frame capable of fitting over a standard toilet, an angled rigid platform fitting on top of the frame, the platform having a cutout to allow a person to use the toilet in the natural squatting position, and hinge elements to allow the frame to go from a folded flat position to an open rectilinear position. A preferred embodiment includes having the platform angled to approximately six degrees.

A SIXTH EXAMPLE, U.S. Pat. No. 6,631,254, Issued on Oct. 14, 2003, to Dixon teaches a height-adjustable footrest for toilets for preferably using while a user is seated upon a toilet stool. The height-adjustable footrest for toilets includes a base being adapted to rest upon a floor; and also includes upright adjustable support assemblies being mounted upon the base and including tubular base members each having an open top end and a bore extending therein, and also including shaft members being movably disposed inwardly and outwardly of the tubular base members; and further includes elongate cross members being mounted upon the shaft members with each of the cross members interconnecting a pair of the shaft members; and also includes elongate footrest support member being pivotally disposed between and interconnecting the elongate cross members; and further includes footrest members being mounted to the elongate footrest support member; and also includes an assembly of raising and lowering the footrest members.

A SEVENTH EXAMPLE, U.S. Pat. No. 6,681,410, Issued on Jan. 27, 2004, to Husain teaches a toilet footrest to enable a toilet user to raise his or her feet to an elevation above floor level to facilitate defecation. The footrest comprises a vertical member and horizontal members placed at horizontally opposed locations along the vertical member. The toilet footrest with bar may be used with or without a base and may also comprise holes having the same cross-sectional area and shape as the horizontal members and placed at horizontally opposed locations along the length of the vertical member. The base of the toilet footrest with bar may also be "U"-shaped to permit easy storage at the base of the toilet. This embodiment permits the user to vary the location of the horizontal members along the vertical member thereby permitting the user to vary the elevation of his/her feet.

AN EIGHTH EXAMPLE, U.S. Patent Office Publication No. 20030019020, Published on Jan. 30, 2003, to Reydel et al. teaches a device and method for treatment of constipation wherein a horizontal bar is positioned a sufficient distance above a toilet that a person using the toilet can passively "semi-hang". The act of passively "semi-hanging" partially removes weight from the perianal area and straightens the torso thereby unfolding the sigmoid colon, increasing the sigmoid-rectal angle and the anorectal angle to facilitate defecation.

A NINTH EXAMPLE, U.S. Patent Office Publication No. 20040177433, Published on Sep. 16, 2004, to Reydel et al. teaches a device and method for treatment of constipation wherein a horizontal bar is positioned a sufficient distance above a toilet that a person using the toilet can passively "semi-hang". The act of passively "semi-hanging" partially removes weight from the perianal area and straightens the torso thereby unfolding the sigmoid colon, increasing the sigmoid-rectal angle and the anorectal angle to facilitate defecation.

It is apparent now that numerous innovations for constipation-relieving apparatuses have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a device for a person to reduce straining during expulsion of fecal matter into a toilet that avoids the disadvantages of the prior art.

ANOTHER OBJECT of the present invention is to provide a device for a person to reduce straining during expulsion of fecal matter into a toilet that is simple and inexpensive to manufacture.

STILL ANOTHER OBJECT of the present invention is to provide a device for a person to reduce straining during expulsion of fecal matter into a toilet that is simple to use.

BRIEFLY STATED, STILL YET ANOTHER OBJECT of the present invention is to provide a device for a person to reduce straining during expulsion of fecal matter into a toilet. The device comprises a block-shaped footrest placed on a floor in front of the toilet. The person sitting on the toilet will place both feet upon the block-shaped footrest to elevate their lower body into a quasi-squat position without any change to above-the-waste posture to reduce straining significantly.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

The figures of the drawings are briefly described as follows.

A MARSHALING OF REFERENCE NUMERALS UTILIZED IN THE DRAWING

Figure 1:
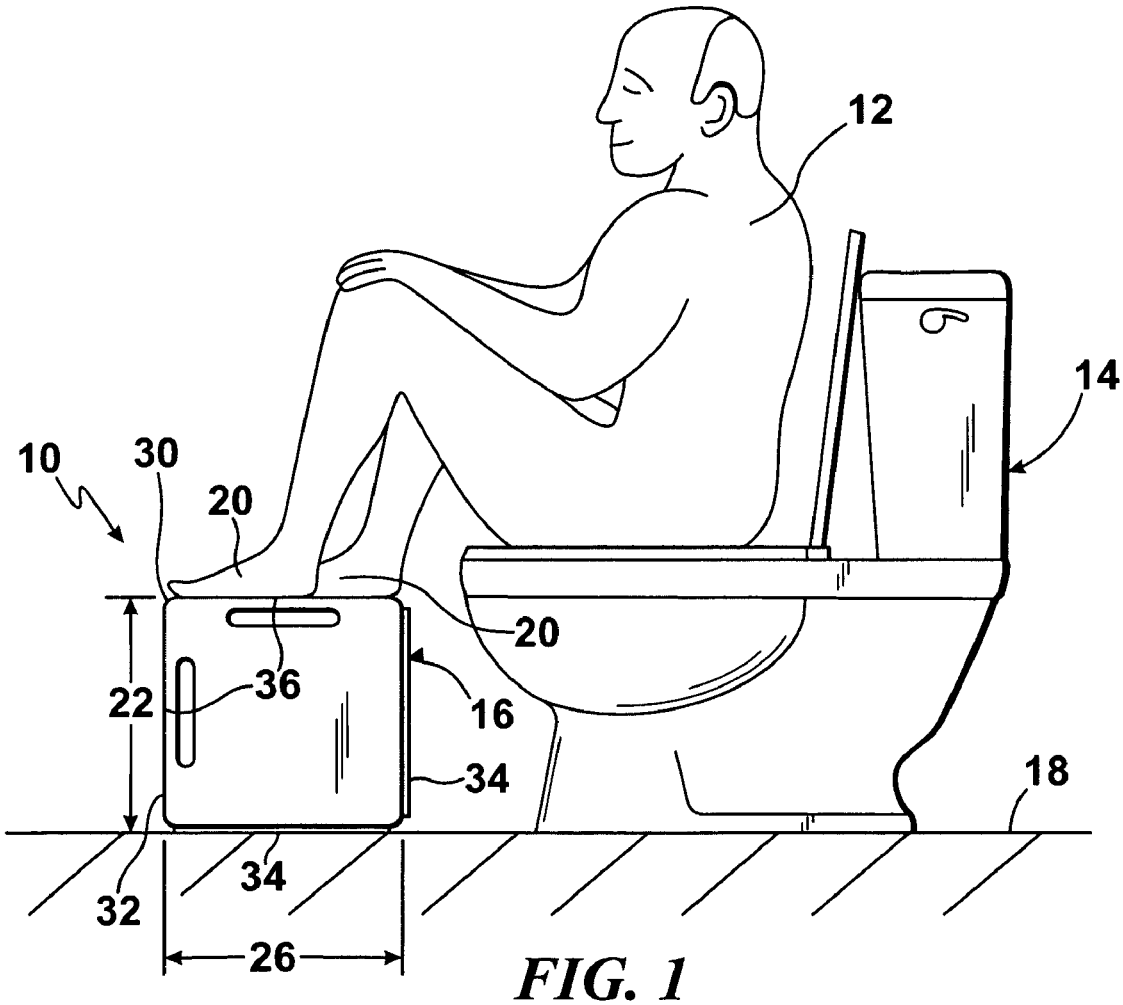
FIG. 1 is a diagrammatic elevational view of an embodiment of the present invention in use.

10 device
12 person
14 toilet
16 block-shaped footrest of device 10
18 floor
20 foot of person 12
22 height of block-shaped footrest 16
24 width of block-shaped footrest 16
26 depth of block-shaped footrest 16
28 lightweight material of block-shaped footrest 16
30 corner of block-shaped footrest 16
32 edge of block-shaped footrest 16
34 no-slip pad of block-shaped footrest 16
36 handle built into edge 32

DETAILED DESCRIPTION OF THE PREFERRED EMBODIMENT

Figure 2:
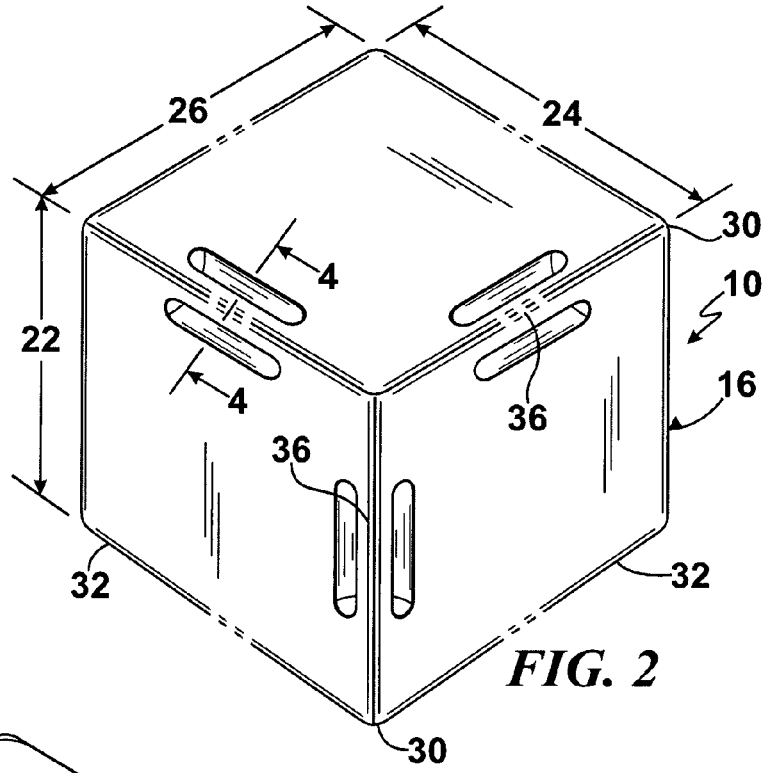
FIG. 2 is a diagrammatic perspective view of the present invention per se showing top, front and right side thereof.
Figure 3:
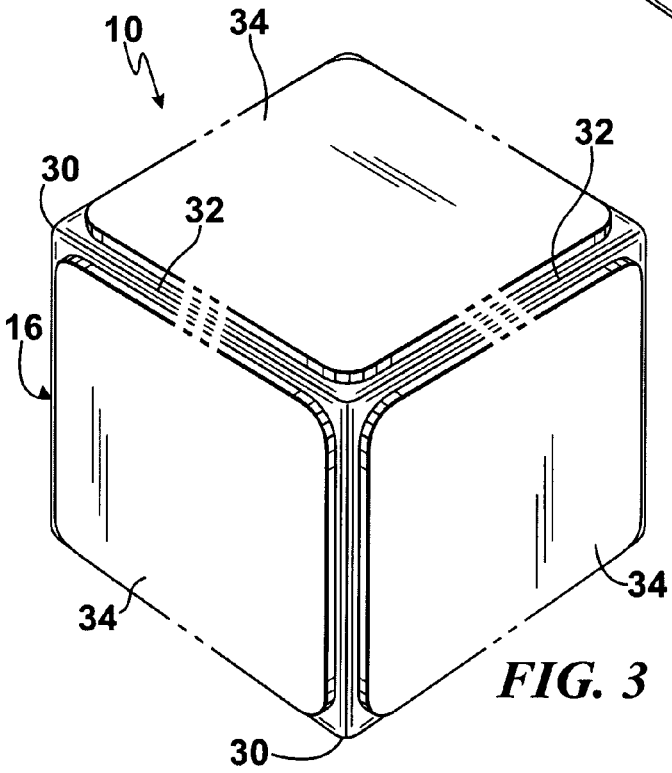
FIG. 3 is a diagrammatic perspective view of the present invention per se showing bottom, rear and left side thereof.

Referring now to the figures, in which like numerals indicate like parts, and particularly to FIGS. 1 through 4, which are a diagrammatic elevational view of an embodiment of the present invention in use; a diagrammatic perspective view of the present invention per se showing top, front and right side thereof; a diagrammatic perspective view of the present invention per se showing bottom, rear and left side thereof; and a diagrammatic cross sectional view, with parts broken away, taken on line 4-4 in FIG. 2, and as such, will be discussed with reference thereto.

The present invention is a device 10 for a person 12 to reduce straining during expulsion of fecal matter into a toilet 14. The device 10 comprises a block-shaped footrest 16 placed on a floor 18 in front of the toilet 14. The person 12 sitting on the toilet 14 will place both feet 20 upon the block-shaped footrest 16 to elevate his/her lower body into a quasi-squat position without any change to above-the-waste posture to reduce straining significantly.

The block-shaped footrest 16 comprises a height 22 of typically ten inches, a width 24 of typically twelve inches and a depth 26 of typically eleven inches, thereby making the block-shaped footrest 16 height adjustable when placed upon the floor 18 in front of the toilet 14 in one of a number of positions.

The block-shaped footrest 16 is comprised of a lightweight material 28. All corners 30 and edges 32 of the block-shaped footrest 16 are curved for safety. The block-shaped footrest 16 comprises at least one no-slip pad 34 affixed to at least one surface to prevent slippage of the feet 20 of the person 12 thereon and to prevent slippage of the block-shaped footrest 16 on the floor 18 depending upon how the block-shaped footrest 16 is positioned with respect to the toilet 14. The block-shaped footrest 16 also comprises at least one handle 36 built into at least one edge 32, wherein the block-shaped footrest 16 can be carried by the at least one handle 36 by the person 12.

Figure 4:
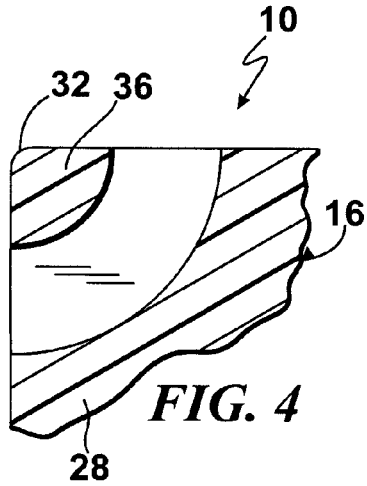
FIG. 4 is a diagrammatic cross sectional view, with parts broken away, taken on line 4-4 in FIG. 2.

As best illustrated in FIG. 4, the at least one handle 36 is a cut-out extending continuously under an edge 32 and into and opening at adjoining surfaces so as to form a smoothly curved channel through the surfaces.

It will be understood that each of the elements described above, or two or more together, may also find a useful application in other types of constructions differing from the types described above.

While the invention has been illustrated and described as embodiments of a device for a person to reduce straining during expulsion of fecal matter into a toilet, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for a person to reduce straining during expulsion of fecal matter into a toilet, said device comprising:

a block-shaped footrest;

wherein said block-shaped footrest is for placing on a floor in front of the toilet so as to allow the person sitting on the toilet to place both feet upon said block-shaped footrest to elevate his/her lower body into a quasi-squat position without any change to above-the-waste posture to reduce straining significantly;

wherein said block-shaped foot rest has edges;

wherein said block-shaped foot rest has surfaces;

wherein said block-shaped footrest has at least one handle;

wherein each edge of said block-shaped footrest separates a pair of adjoining surfaces of said block-shaped footrest; and wherein each handle of said block-shaped footrest is a cut-out extending continuously under an edge of said block-shaped footrest and into and opening at said adjoining surfaces of said block-shaped footrest adjoined by said edge of said block-shaped footrest so as to form a smoothly curved channel through said surfaces of said block-shaped footrest adjoined by said edge of said block-shaped footrest for insertion of a hand of the person when said device is carried.

2. The device as recited in claim 1, wherein said block-shaped footrest comprises a height of typically ten inches, a width of typically twelve inches and a depth of typically eleven inches, thereby making said block-shaped footrest height adjustable when placed upon the floor in front of the toilet in one of a number of positions.

3. The device as recited in claim 1, wherein said block-shaped footrest is comprised of a lightweight material.

4. The device as recited in claim 1, wherein said block-shaped footrest has corners; and wherein all of said corners and said edges of said block-shaped footrest are curved for safety.

5. The device as recited in claim 1, wherein said block-shaped footrest comprises at least one no-slip pad affixed to at least one surface to prevent slippage of the feet of the person thereon and to prevent slippage of said block-shaped footrest on the floor depending upon how said block-shaped footrest is positioned with respect to the toilet.

* * * * *